US008025035B2

(12) United States Patent
Berger

(10) Patent No.: US 8,025,035 B2
(45) Date of Patent: Sep. 27, 2011

(54) MECHANICAL VARIABLE CAMSHAFT TIMING DEVICE

(75) Inventor: Alvin Henry Berger, Brownstown, MI (US)

(73) Assignee: Ford Global Technologies, LLC, Dearborn, MI (US)

( * ) Notice: Subject to any disclaimer, the term of this patent is extended or adjusted under 35 U.S.C. 154(b) by 379 days.

(21) Appl. No.: 12/351,049

(22) Filed: Jan. 9, 2009

(65) Prior Publication Data

US 2010/0175648 A1 Jul. 15, 2010

(51) Int. Cl.
*F01L 1/34* (2006.01)

(52) U.S. Cl. ..... 123/90.16; 123/90.15; 74/724; 464/160

(58) Field of Classification Search ..... 123/90.15, 123/90.16, 90.17, 90.18; 74/724; 464/1, 464/2, 160

See application file for complete search history.

(56) References Cited

U.S. PATENT DOCUMENTS

| | | | |
|---|---|---|---|
| 3,516,394 | A | 6/1970 | Nichols |
| 4,517,934 | A | 5/1985 | Papez |
| 4,770,060 | A | 9/1988 | Elrod et al. |
| 4,771,742 | A | 9/1988 | Nelson et al. |
| 4,917,058 | A | 4/1990 | Nelson et al. |
| 5,136,887 | A | 8/1992 | Elrod et al. |
| 5,156,119 | A | 10/1992 | Suga |
| 5,161,429 | A | 11/1992 | Elrod et al. |
| 5,161,493 | A | 11/1992 | Ma |
| 5,253,546 | A | 10/1993 | Elrod et al. |
| 5,355,849 | A | 10/1994 | Schiattino |
| 5,417,186 | A | 5/1995 | Elrod et al. |
| 5,642,703 | A | 7/1997 | Stockhausen et al. |
| 6,237,559 | B1 | 5/2001 | Russ et al. |
| 7,069,892 | B2 | 7/2006 | Lechner et al. |
| 7,140,335 | B2 | 11/2006 | Moretz et al. |
| 7,273,024 | B2 | 9/2007 | Lancefield et al. |
| 7,284,521 | B2 | 10/2007 | Lechner et al. |
| 2003/0159670 | A1 | 8/2003 | Simpson et al. |
| 2007/0056541 | A1 | 3/2007 | Meintschel et al. |

FOREIGN PATENT DOCUMENTS

| | | |
|---|---|---|
| WO | 88/01337 | 2/1988 |
| WO | 8801337 A1 | 2/1998 |

OTHER PUBLICATIONS

Printout from www.nytimes.com/2007/01/14/automobiles/14V1PER.

*Primary Examiner* — Ching Chang
(74) *Attorney, Agent, or Firm* — Julia Voutyras; Brooks Kushman P.C.

(57) ABSTRACT

A device for selectively changing phase relationship between first and second rotating shafts in an internal combustion engine where the first shaft is secured for rotation with a worm carrier assembly and the second shaft is secured for rotation with a worm gear includes first and second worms disposed for rotation within the worm carrier assembly and having torsional preloads with opposite hands of rotation and meshing with the worm gear. An actuator turns the first and second worms in a first direction to advance rotation of the second shaft relative to the first shaft and turns the first and second worms in a second direction to retard rotation of the second shaft relative to the first shaft.

20 Claims, 9 Drawing Sheets

MECHANICAL VARIABLE CAMSHAFT TIMING DEVICE

BACKGROUND

1. Technical Field

The present disclosure relates to a mechanical or non-hydraulic variable camshaft timing device for an internal combustion engine.

2. Background Art

Variable camshaft timing (VCT) devices may be used to change the phase relationship between the crankshaft and the camshaft lobes that control actuation of the gas exchange valves. In general, control of the phase relationship facilitates better management of fuel economy, performance, and emissions by providing less valve overlap at idle and low engine speeds for good combustion stability, and more valve overlap at higher engine speeds for better power and performance. Pressurized engine lubricating oil is often used to hydraulically actuate VCT devices. However, temperature-related viscosity changes often present challenges for consistent performance of hydraulically actuated VCT systems. In addition, hydraulically actuated VCT systems may require higher oil pressure and a correspondingly larger, heavier oil pump with higher parasitic losses than otherwise required to provide adequate engine lubrication, resulting in lower overall engine efficiency and fuel economy.

A mechanically actuated phaser for adjusting the timing between a camshaft and crankshaft as disclosed in US 2003/0159670 uses solenoid-actuated rotation of a worm gear to vary the angular relationship between the camshaft drive sprocket and a camshaft drive gear. This strategy recognizes that a worm gear with a high mechanical advantage will rotate when torque is applied to the worm, but a constant torque applied to the worm gear will not produce rotation of the worm so that the device can maintain a selected position. However, US 2003/0159670 does not recognize that the dynamic loading associated with valve actuation creates a fluctuating load applied to the worm gear that can cause rotation of the worm similar to the manner in which an under-torqued bolt can vibrate loose. As such, the lash necessary for operation of the worm in this arrangement makes it difficult to hold a constant position when subjected to the dynamic loading of the camshaft during operation of the intake and/or exhaust valves and may require constant adjustment by the actuating solenoid. In addition, packaging constraints with an internal worm gear meshing with internal ring gear teeth require small components that may encounter reliability/durability issues.

SUMMARY

A device for selectively changing phase relationship between first and second rotating shafts in an internal combustion engine may be implemented by an apparatus that includes first and second worms disposed for rotation within a worm carrier assembly secured for rotation with the first shaft and having torsional preloads with opposite hands of rotation and meshing with a worm gear secured for rotation with the second shaft. An actuator turns the first and second worms in a first direction to advance rotation of the second shaft relative to the first shaft, and turns the first and second worms in a second direction to retard rotation of the second shaft relative to the first shaft. The device may also be implemented by a method for changing relative rotational phase between first and second rotating shafts in an internal combustion engine that includes biasing a first worm assembly to apply a clockwise rotational bias torque between the first and second shafts, biasing a second worm assembly to apply a counterclockwise rotational bias torque between the first and second shafts to maintain the rotational phase between the first and second shafts during rotation other than during phase change actuation, and applying an actuating torque to the first and second worm assemblies during phase change actuation to selectively change the rotational phase between the first and second rotating shafts during rotation.

In one embodiment, the phase relationship between first and second coaxial camshafts is changed by applying a frictional dragging force to a front side gear causing the front side gear to rotate backward relative to the outer camshaft and worm carrier assembly. The relative motion applies an actuating torque to turn worm pinion gears that are in meshing engagement with the rear side gear and coupled to corresponding worms that are in meshing engagement with a common worm gear secured for rotation with the inner camshaft thereby advancing rotation of the inner camshaft relative to the outer camshaft. Applying a frictional dragging force to a rear side gear creates relative motion between the rear side gear and the worm carrier assembly to apply an actuating torque to turn the worm pinion gears in the opposite direction to retard rotation of the inner camshaft relative to the outer camshaft. A torsional preload is applied to the worm pinions relative to the worms by a torsion element implemented in one embodiment by a small diameter quill that indirectly couples the worm pinions to corresponding worms.

The present disclosure includes embodiments having various advantages. For example, the systems and methods of the present disclosure provide a mechanically, non-hydraulically actuated variable camshaft timing device that can be used to adjust the phase relationship between the camshaft and crankshaft and/or the relationship between coaxial camshafts operating intake and/or exhaust valves. Embodiments of the present disclosure provide compact packaging with desired reliability and durability such that the device can be implemented without increasing the length of camshaft bearings and with minimal or no overall increase in engine length. Opposite hand preload torque reduces or effectively eliminates backlash during operation of the device to reduce noise and wear. Friction locking within the advance/retard mechanism maintains the angular relationship between associated rotating shafts under dynamic loading during operation to reduce or eliminate the need for ongoing adjustments by the actuating device.

The above advantages and other advantages and features will be readily apparent from the following detailed description of the preferred embodiments when taken in connection with the accompanying drawings.

DETAILED DESCRIPTION OF EMBODIMENTS OF THE INVENTION

As those of ordinary skill in the art will understand, various features of the embodiments illustrated and described with reference to any one of the Figures may be combined with features illustrated in one or more other Figures to produce embodiments that are not explicitly illustrated or described. The combinations of features illustrated provide representative embodiments for typical applications. However, various combinations and modifications of the features consistent with the teachings of the present disclosure may be desired for particular applications or implementations. The representative embodiments used in the illustrations relate generally to a multi-cylinder, internal combustion engine having a non-hydraulic variable cam timing device to vary the angular relationship between the camshaft and crankshaft and/or between sets of camshaft lobes. However, those of ordinary skill in the art may recognize similar applications or implementations with other engine/vehicle technologies.

Figure 1A:
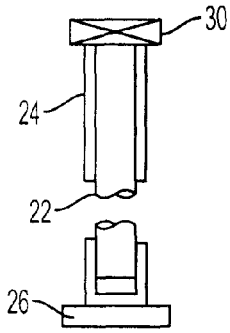
FIGS. 1A and 1B illustrate a representative arrangement of a device having coaxial camshafts with one cam axis per cylinder head for changing phase relationship between the inner and outer camshafts according to embodiments of the present disclosure.
Figure 2A:
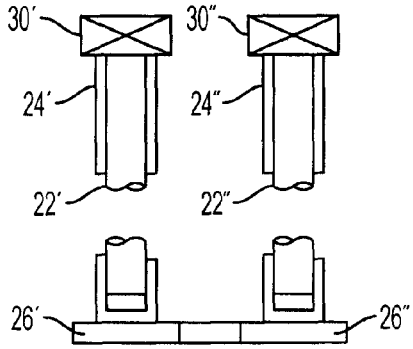
FIGS. 2A and 2B illustrate a representative arrangement of a device having coaxial camshafts with two cam axes per cylinder head for changing phase relationship between two or more rotating shafts according to embodiments of the present disclosure.
Figure 3A:
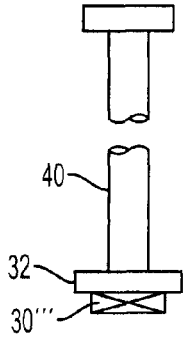
FIGS. 3A and 3B illustrate a representative arrangement of a device for changing phase relationship between a conventional camshaft and crankshaft according to embodiments of the present disclosure.
Figure 1B:
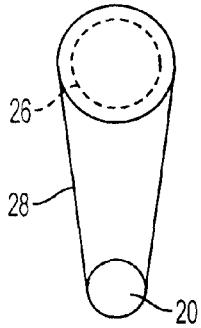
Figure 2B:
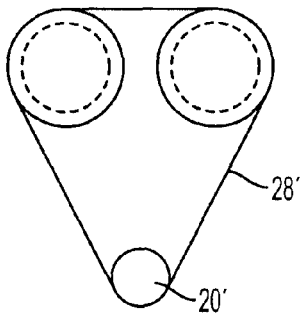
Figure 3B:
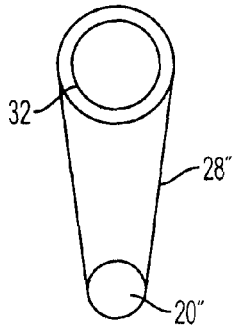

FIGS. 1-3 illustrate representative arrangements for controlling the rotational phase relationship between two or more rotating shafts of an internal combustion engine using a device or devices according to the present disclosure. Those of ordinary skill in the art will recognize that although the representative examples of FIGS. 1-3 illustrate a device according to the present disclosure used to change the relationship between two camshafts and/or between a camshaft and a crankshaft, other suitable applications for such a device exist. Likewise, a mechanical phaser according to the present disclosure is not limited to the illustrated arrangements and one or more such devices may be used depending upon the particular application and implementation. In the representative arrangements illustrated, the function or role of any particular camshaft may vary by application and implementation to operate intake valves, exhaust valves, or both.

In the arrangement represented by the top view of FIG. 1A and the front view of FIG. 1B, an engine having a single cam axis for each cylinder head includes a coaxial camshaft having an inner exhaust camshaft 22 for operating exhaust valves and an outer intake camshaft 24 for operating intake valves, or vice versa. As such, an in-line or I-type cylinder configuration would include a single crankshaft 20 and coaxial camshaft 22, 24 whereas a V-type configuration would include two cylinder heads each having a coaxial camshaft 22, 24 connected to a single crankshaft 20. In either arrangement, outer camshaft 24 may be driven by a drive sprocket 26 connected by a chain or belt 28 to crankshaft 20. Alternatively, outer camshaft 24 may be driven by a hydraulic phaser (not shown) to selectively change the phase relationship between crankshaft 20 and outer camshaft 24, although use of a hydraulic phaser in combination with a mechanical phaser according to the present disclosure may not achieve all of the advantages of exclusive use of mechanical phasers, such as cold temperature performance, lower oil pressure operation, etc. A mechanical phaser 30, as described in greater detail herein, drives inner camshaft 22 using first and second oppositely biased worm assemblies to selectively change the phase relationship between outer camshaft 24 and inner camshaft 22.

The representative arrangement illustrated in FIG. 2 represents a dual overhead camshaft arrangement with two cam axes per cylinder head. A first cam axis is associated with first inner camshaft 22' and first outer camshaft 24' that both operate intake valves with at least two intake valves per cylinder. A second cam axis is associated with second inner camshaft 22" and second outer camshaft 24" that both operate exhaust valves with at least two exhaust valves per cylinder. Outer camshafts 24', 24" may be driven directly from chain 28' or indirectly through conventional hydraulic phasers (not shown) positioned at the front of each coaxial camshaft. Mechanical phasers 30', 30" control timing of the valves operated by cam lobes on corresponding inner camshafts 22', 22". Appropriate staggered or offset control of the valve opening timing of the two valves provides a longer overall duration of the opening event.

A mechanical phaser according to the present disclosure has no inherent limits to its range of control as compared to hydraulic phasers that are typically limited to around thirty degrees of total motion at the camshaft (or sixty degrees as measured by crankshaft rotation). Hydraulic phaser arrangements may be used to implement dual dependent variable cam timing with a first drive chain coupled to the crankshaft to drive one of the camshafts through a first phaser and a second drive chain running between the dual camshafts to drive the other camshaft through a second phaser. This provides the second camshaft a greater total range of adjustment relative to the crankshaft than what could be achieved with a dual independent configuration using conventional hydraulic phasers. The mechanical phasers of the present disclosure may be used to implement dual independent variable cam timing with the phaser of each camshaft receiving its input from the drive chain coupled to the crankshaft. This mechanical dual independent configuration has a larger range of authority over the second camshaft timing than does the hydraulic dual dependent arrangement, but does not force one of the phasers to carry the loads of both camshafts.

In the representative arrangement of FIG. 3, crankshaft 20" drives sprocket 32, which is coupled to a conventional one-piece camshaft 40 via mechanical phaser 30'". As best illustrated in the cross-section of FIG. 14, drive sprocket 32 is located near the front bearing and the radial chain load from chain 28" is supported by camshaft 40 and associated bearings that carry the cantilevered load out past the front bearing. This arrangement uses mechanical phaser 30'" to selectively change the phase relationship between rotating crankshaft 20" and camshaft 40.

Figure 4:
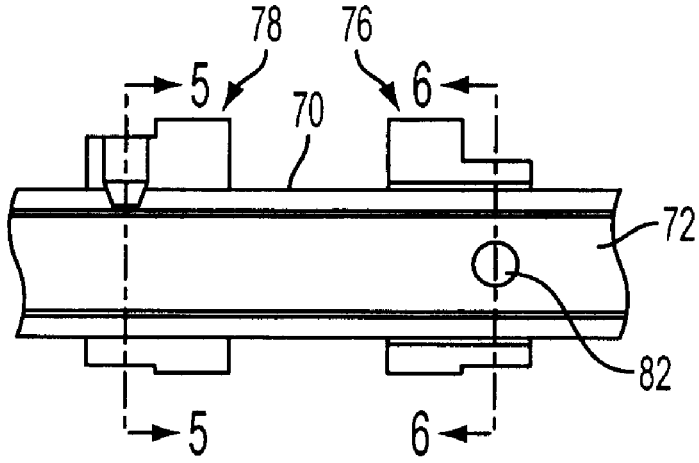
FIG. 4 is a top cross-sectional view of a representative coaxial camshaft for use with a device for changing phase relationship according to embodiments of the present disclosure.
Figure 5:
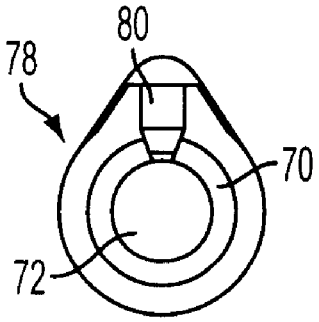
FIG. 5 is a cross-section along line 5-5 of the coaxial camshaft of FIG. 4 illustrating a fixed cam lobe.
Figure 6:
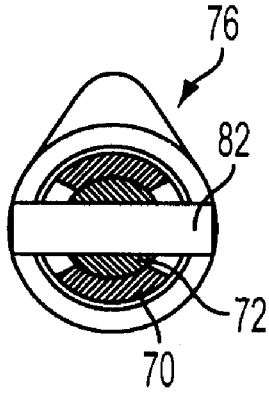
FIG. 6 is a cross-section along line 6-6 of the coaxial camshaft of FIG. 4 illustrating a variable cam lobe.
Figure 7:
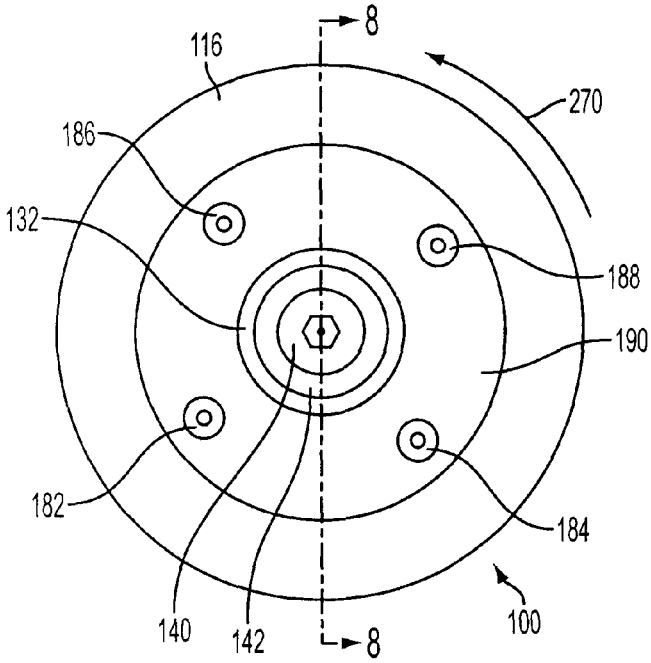
FIG. 7 is an end view of one embodiment of a device for changing phase relationship according to the present disclosure.

FIGS. 4-6 illustrate a representative coaxial camshaft for use with a device for changing phase relationship between first and second rotating shafts according to the present disclosure. In this arrangement, outer camshaft 70 carries adjustable cam lobe 76 (best shown in FIG. 6) and fixed cam lobe 78 (best shown in FIG. 5) on one diameter to ensure concentricity and carries associated radial loads of valve actuation. Inner camshaft 72 carries minimal or no bending load from the valve opening forces, but provides the torque needed to drive adjustable cam lobes 76. Inner camshaft 72 is supported on two bushings (not shown) at either end. Fixed cam lobes 78 are rigidly connected to outer camshaft 70 with set screw 80, or camshaft 70 may be swaged into the fixed cam lobes. Adjustable cam lobes 76 are free to rotate on outer camshaft 70 via a bushing (not shown) within their inner diameter. Adjustable cam lobes 76 are driven by inner camshaft 72 via dowel pin 82 that connects through slots in outer shaft 70. During operation, a variable cam timing device as illustrated and described herein may be used to change the phase relationship between outer camshaft 70 and inner camshaft 72.

FIGS. 7-12 illustrate one embodiment of a device for selectively varying a relative angular position between first and second rotating shafts of an internal combustion engine according to the present disclosure. Device 100 includes a first worm assembly 102 coupled to first rotating shaft 110 via worm carrier 160 and second rotating shaft 112 via gear 132, and torsionally preloaded to provide a first torque tending to increase the relative angular position between the first and second shafts, and a second worm assembly 104 coupled to the first and second rotating shafts 110, 112 and torsionally preloaded opposite to the first assembly 102 to provide a second torque simultaneously tending to decrease the relative angular position between first and second shafts 110, 112 such that backlash and torsional freeplay between the two shafts is removed and the relative angular position of the first and second shafts remains substantially constant during rotation of the shafts whenever their angular phase relationship is not being adjusted. At least one actuator acts on rear side gear 116 and front side gear 118 and selectively applies an actuating torque to respective worm pinions 120, 122 of the first and second worm assemblies 102, 104 to rotate the second shaft 112 relative to the first shaft 110 and change the relative angular position between the first and second shafts 110, 112.

In one embodiment, device 100 is fitted to the rear of a coaxial camshaft having an outer camshaft 110 and inner camshaft 112. A front side plate 130 is electron beam welded onto the rear end of outer camshaft 110. A worm gear 132 is welded onto a tube 134 disposed within outer camshaft 110 with a running fit, and is pressed tightly onto a reduced diameter section 136 toward the rear end of inner camshaft 112. A screw 140 engages corresponding threads (not shown) within inner camshaft 112 and clamps washer 142 and tube 134 against the shoulder formed by reduced diameter portion 136 of inner camshaft 112. Additional torque carrying capacity may be provided by a splined interface or by a pin (not shown) passing through tube 134 and inner camshaft 112. Depending on the particular application and implementation, a common pin could be used to attach a cam lobe and tube 134 to inner camshaft 112.

Figure 8:
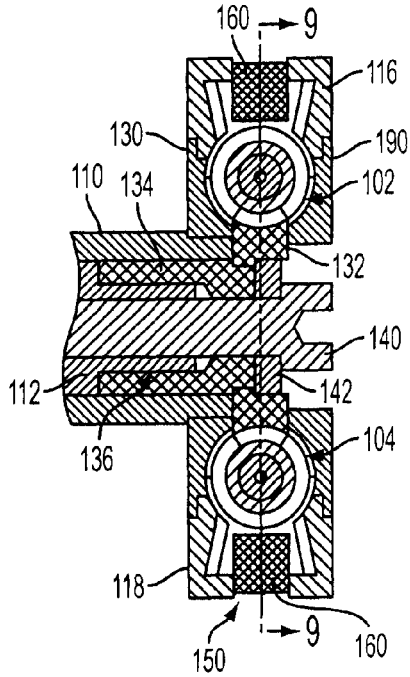
FIG. 8 is a cross-section along line 8-8 of the embodiment of FIG. 7.
Figure 9:
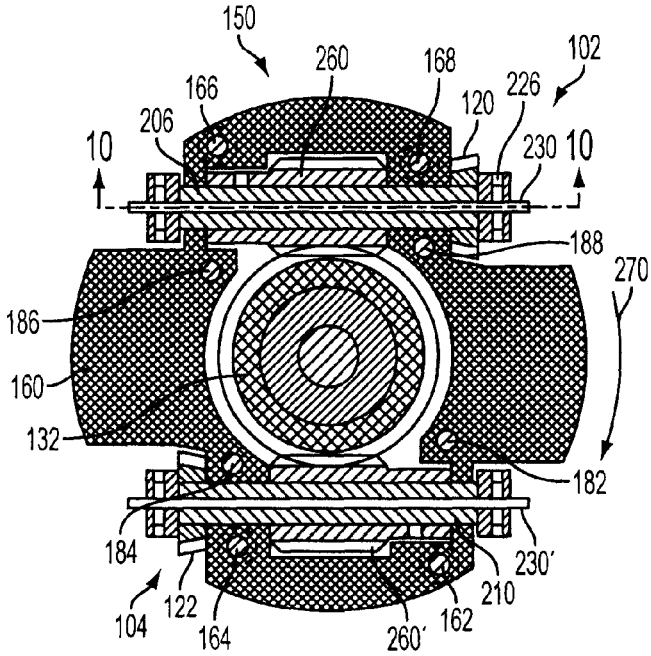
FIG. 9 is a cross-section along line 9-9 of the cross-section of FIG. 8.
Figure 10:
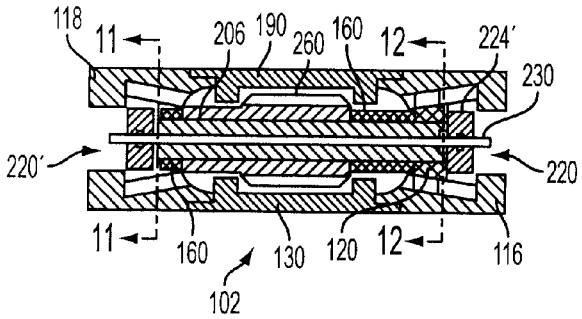
FIG. 10 is a cross-section along line 10-10 of the cross-section of FIG. 9.
Figure 11:
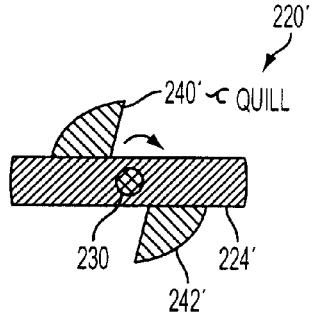
FIG. 11 is a cross-section along line 11-11 of the cross-section illustrated in FIG. 10.
Figure 12:
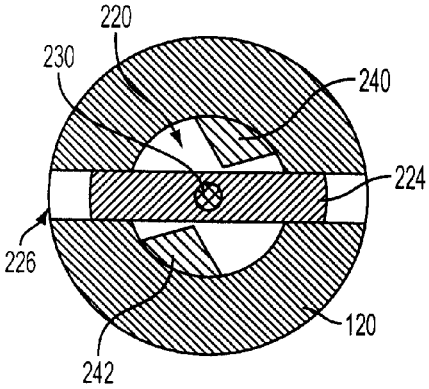
FIG. 12 is a cross-section along line 12-12 of the cross-section illustrated in FIG. 10.

As best illustrated in the cross-sections of FIGS. 8-9, a worm carrier assembly 150 contains first and second worm assemblies 102, 104. Carrier assembly 150 includes carrier 160 that is assembled around worm gear 132 which is attached to inner camshaft 112 through tube 134. Four flat head screws or rivets 162, 164, 166, 168 hold the two halves of carrier 160 together to contain the worm assemblies 102, 104. Four additional flat head screws or rivets 182, 184, 186, 188 pass through rear side plate 190, through carrier 160, and into front side plate 130, attaching the carrier assembly 150 to outer camshaft 110 via the electron beam weld previously described. The actuator, which in this embodiment includes front side gear 118 and rear side gear 116, includes teeth in meshing engagement with worm pinions 120, 122 and are captured between carrier 160 and front side plate 130 and rear side plate 190, respectively, in a manner that constrains fore/aft, and radial motion of side gears 116, 118, but allows each side gear 116, 118 to rotate about the axis of camshafts 110, 112, while transferring torque to/from worm pinions 120, 122. The meshing engagement between side gears 116, 118 and worm pinions 120, 122 is best illustrated in the cross-section of FIG. 10.

In the embodiment shown in FIGS. 7-12, the axes of worm pinions 120, 122 and the common axis of side gears 116, 118 do not intersect with one another. As such, worm pinion gears 120, 122 and the mating side gears 116, 118 are constructed with a hypoid design, similar to the gears used in the rear axle of many rear wheel drive vehicles with front mounted engines. Worm pinions 120, 122 have a running fit to respective worm shafts 206, 210 and transmit torque to a quill clamp 220 that has a blade 224 engaged into a slot 226 on the end of pinion gear 120 as best illustrated in the cross-sections of FIGS. 10-12. This quill clamp 220, in turn, transmits torque to a torsion element implemented by a quill 230 in this embodiment. Quill 230 passes through the length of worm shaft 206, and the torque is received by another quill clamp 220' at the opposite end of worm shaft 206. Each quill clamp is attached to quill 230 by a pair of set screws 226. A torsional preload can be imparted to quill 230 by twisting and holding the ends of the quill that extend beyond clamps 220 and 220' while the set screws are being tightened. This second quill clamp 220' also has a blade 224' that transmits the torque to drive lugs 240', 242' on the corresponding end of worm shaft 206. When quill 230 reaches a certain level of torsional load, elastic deformation of quill 230 allows quill clamp 220 to rotate relative to worm shaft 206 so that blade 224 contacts drive lugs 240, 242 of worm shaft 206 at the pinion end and any increased level of torque is transmitted from pinion gear 120 to worm shaft 206, at that contact, without further deformation of quill 230. A worm 260 is secured to worm shaft 206 so that rotation of worm shaft 206 produces rotation of worm 260, and consequent rotation of worm gear 132 such that inner camshaft 112 rotates relative to worm carrier assembly 150 and outer camshaft 110.

In operation, an actuator under control of an engine control module applies a frictional dragging force on front side gear 118 causing it to rotate backward relative to outer camshaft 110 and worm carrier assembly 150. The relative motion causes worm pinions 120, 122 to rotate respective worms 260, 260' in a clockwise direction as viewed from the worm pinion gear end of each worm assembly. Because worms 260, 260' both have a right hand thread, clockwise rotation of worms 260, 260' will cause inner camshaft 112 to advance or move in the direction of rotation indicated by arrows 270 relative to outer camshaft 110. Similarly, when an actuator under control of the engine control module applies a frictional dragging force to rear side gear 116 causing rear side gear 116 to rotate backward relative to outer camshaft 110 and worm carrier assembly 150, the relative motion causes counterclockwise rotation of worms 260, 260' to retard inner camshaft 112 relative to outer camshaft 110.

During operation of the engine, as the outer camshaft 110 and inner camshaft 112 rotate to actuate valves coupled by cam followers and corresponding cam lobes, the action of the cam lobes on the followers produces an oscillating torsional load between outer camshaft 110 and inner camshaft 112. As such, it is desirable to reduce or eliminate backlash within the device to prevent noise and wear and to maintain a desired phase relationship between the rotating shafts when no actuating torque is applied to rear side gear 116 or front side gear 118. According to one aspect of the present disclosure, this is accomplished by having opposite hand torsional preload on the two worm assemblies 102, 104. When the variable cam timing device is rotating at a steady-state without advancing or retarding, worm assembly 102 is torsionally preloaded or biased in a direction attempting to advance inner camshaft 112, while worm assembly 104 has an opposite preload or bias that attempts to retard inner camshaft 112. Because worms 260, 260' have a relatively fine thread pitch, a torque applied to the worms can produce rotation of worm gear 132. However, the converse does not produce movement, i.e. because of the friction locking between worm gear 132 and worms 260, 260', a torque applied to worm gear 132 will not produce rotation of worms 260, 260', as long as the worms have any amount of resisting torque. The torsional preloads between worm pinion gears 120, 122 and the associated worm shafts 206, 210 are transmitted through the corresponding quills 230, 230', respectively. In the steady state condition, worm assembly 102 has a clockwise preload on its quill 230, and worm assembly 104 has a counterclockwise preload on its quill 230'.

Figure 13:
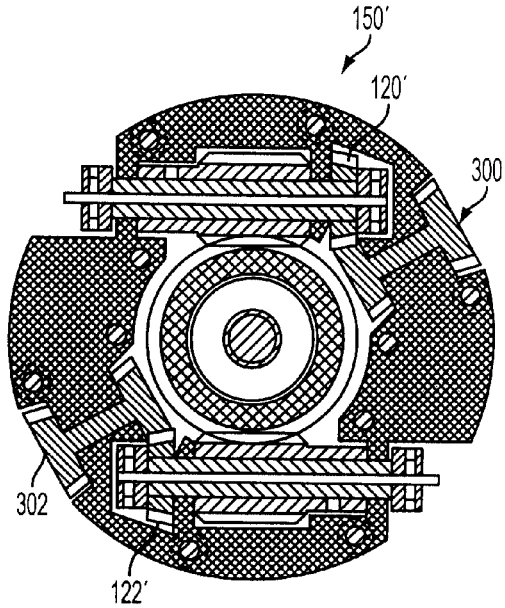
FIG. 13 is a cross-section illustrating an alternative embodiment having bevel gears in place of hypoid gears.

FIG. 13 illustrates an alternative embodiment of a carrier assembly 150' having intermediate gear assemblies 300, 302, with one end in meshing engagement with a corresponding worm pinion gear 120', 122', respectively, and an opposite end in meshing engagement with the actuating gear(s) implemented by a front side gear and rear side gear as described with respect to the embodiment illustrated in FIGS. 7-12. Intermediate gear assemblies 300, 302 are positioned with axes intersecting the axes of corresponding pinion gears 120' and 122', and also the common axis of the front and rear side actuating gears such that bevel gears may be used rather than hypoid gears.

Figure 14:
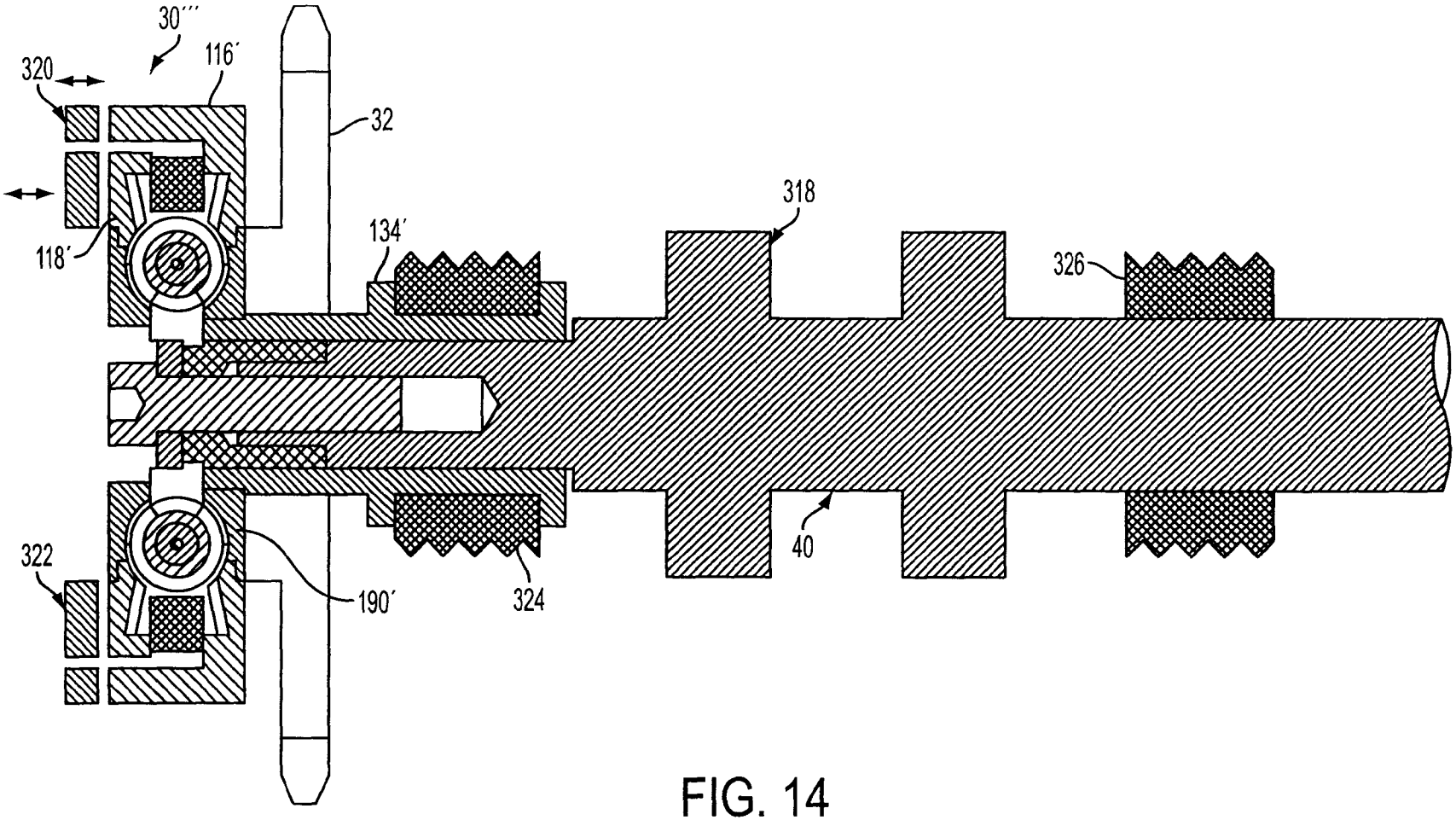
FIG. 14 is a cross-section illustrating an arrangement using one embodiment of a device operating as a primary phaser on a conventional camshaft to selectively change the phase relationship between the crankshaft and camshaft according to the present disclosure.

FIG. 14 is a cross-sectional view of a mechanical phaser 30''' used with a conventional camshaft 40 such as illustrated in the diagram of FIG. 3. Camshaft 40 includes cam lobes 318 to operate corresponding intake/exhaust valves and may be constructed with no mechanical limits on its range of phase adjustment relative to camshaft drive sprocket 32. Camshaft drive sprocket 32 may be attached in any suitable manner to rear side plate 190', or may be integrally formed therewith. Outer stub shaft 134' is secured to rear side plate 190' and rotates with sprocket 32, which is located near front bearing 324. The radial chain load applied through sprocket 32 is supported by camshaft 40, which is in turn supported by various other bearings, such as second camshaft bearing 326 to carry the cantilevered load of the mechanical phaser and sprocket assembly out past front bearing 324. During operation, a first axial actuator 320 selectively applies a frictional dragging torque to rear side gear 116' to retard the rotation of camshaft 40 relative to sprocket 32 and crankshaft 20'' (FIG. 3) as previously described with reference to the embodiment of FIGS. 7-13. Similarly, to advance rotation of camshaft 40 relative to sprocket 32 and crankshaft 20'' (FIG. 3), a second axial actuator 322 selectively applies a frictional dragging torque to front side gear 118'. First and second actuators or brakes 320, 322 may be mounted to the engine front cover or other stationary component depending on the particular application and implementation.

Figure 15:
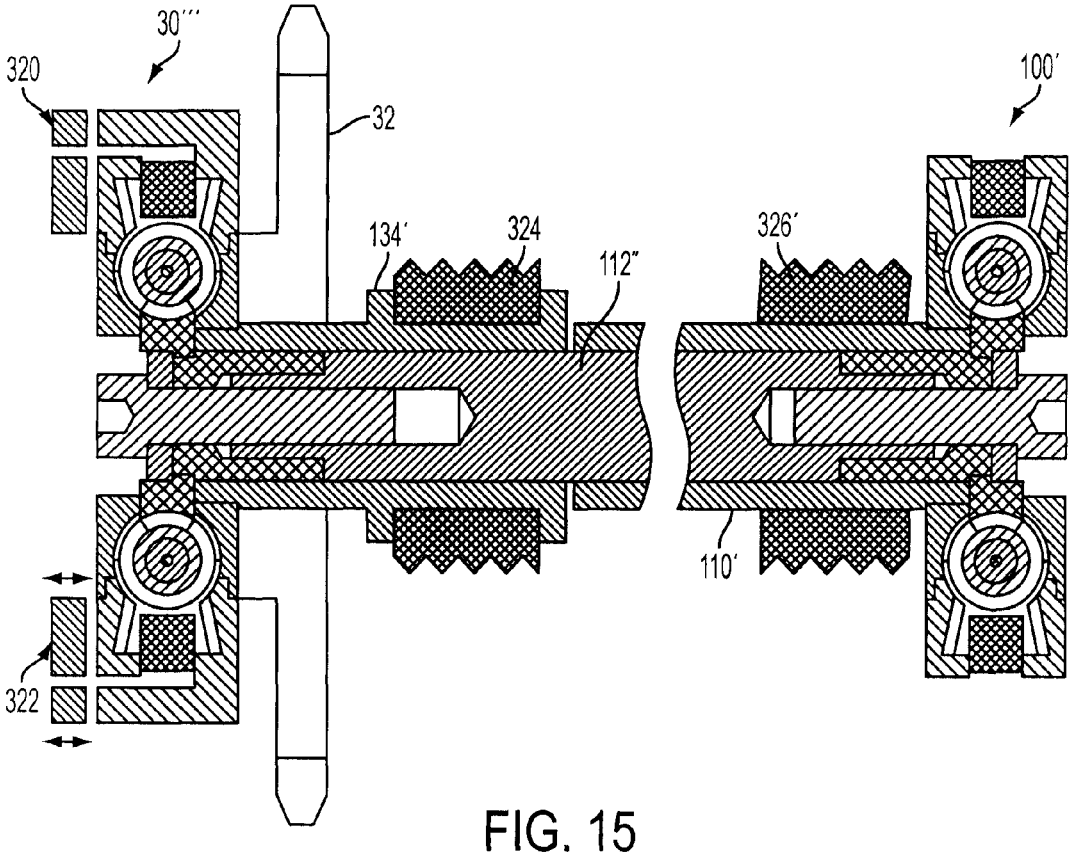
FIG. 15 is a cross-section illustrating an arrangement having two devices for changing phase relationship between coaxial camshafts and a crankshaft according to the present disclosure.

FIG. 15 is a cross-sectional view of another arrangement for selectively changing the phase relationship between two or more rotating shafts of an internal combustion engine according to the present disclosure. In the arrangement of FIG. 15, a first (front) device 30''' controls the phase relationship of inner coaxial camshaft 112' relative to drive sprocket 32 while a second (rear) device 100' controls the phase relationship of outer coaxial camshaft 110' relative to inner coaxial camshaft 112'. Similar to the arrangement illustrated in FIG. 14, the arrangement of FIG. 15 eliminates the use of any hydraulic phaser, which may facilitate use of a smaller oil pump and lower operating oil pressure.

Figure 16:
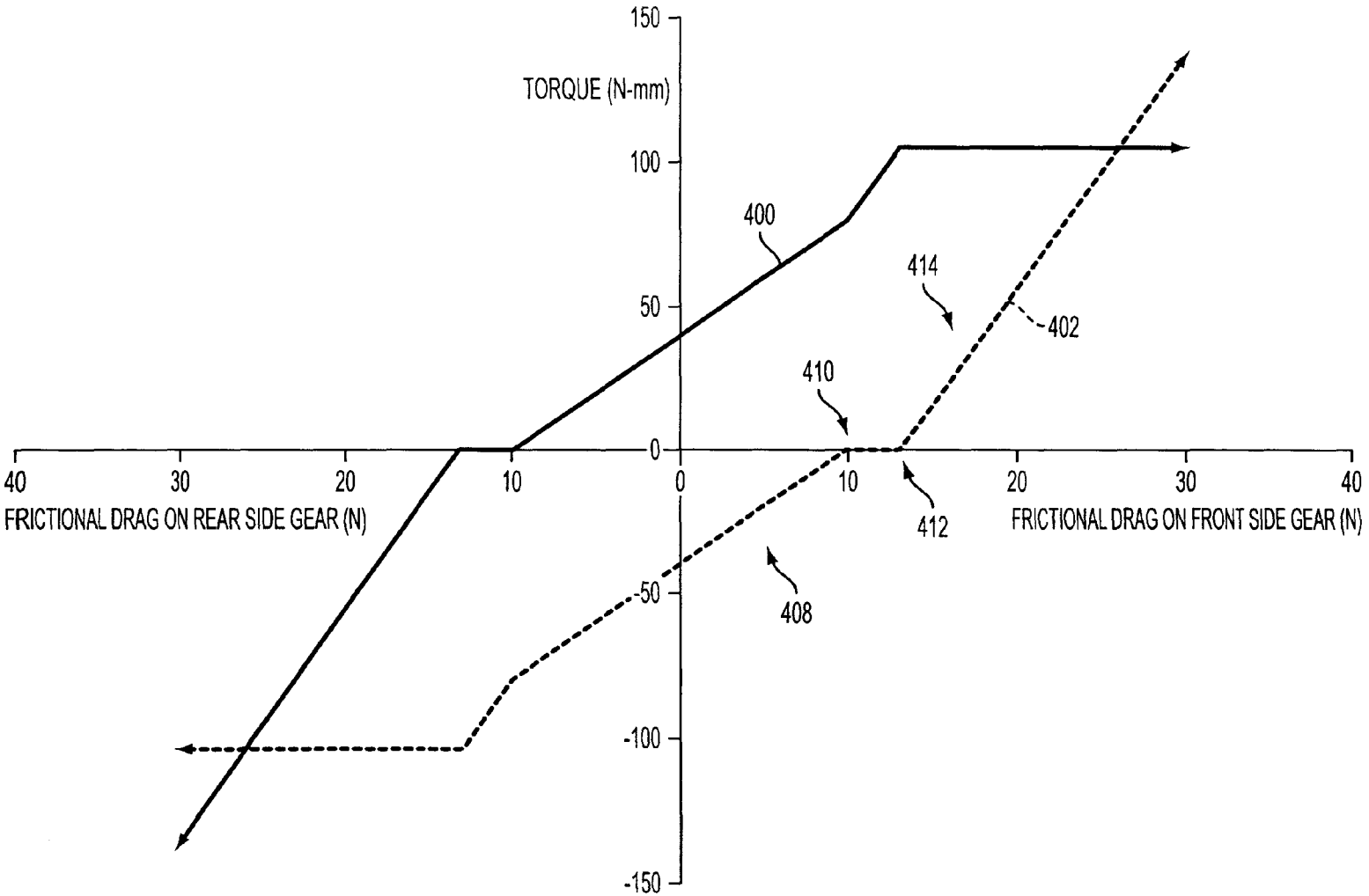
FIG. 16 is a graph illustrating the relationship between an actuating torque and torque applied to the first and second worm assemblies for a first torsional preload.
Figure 17:
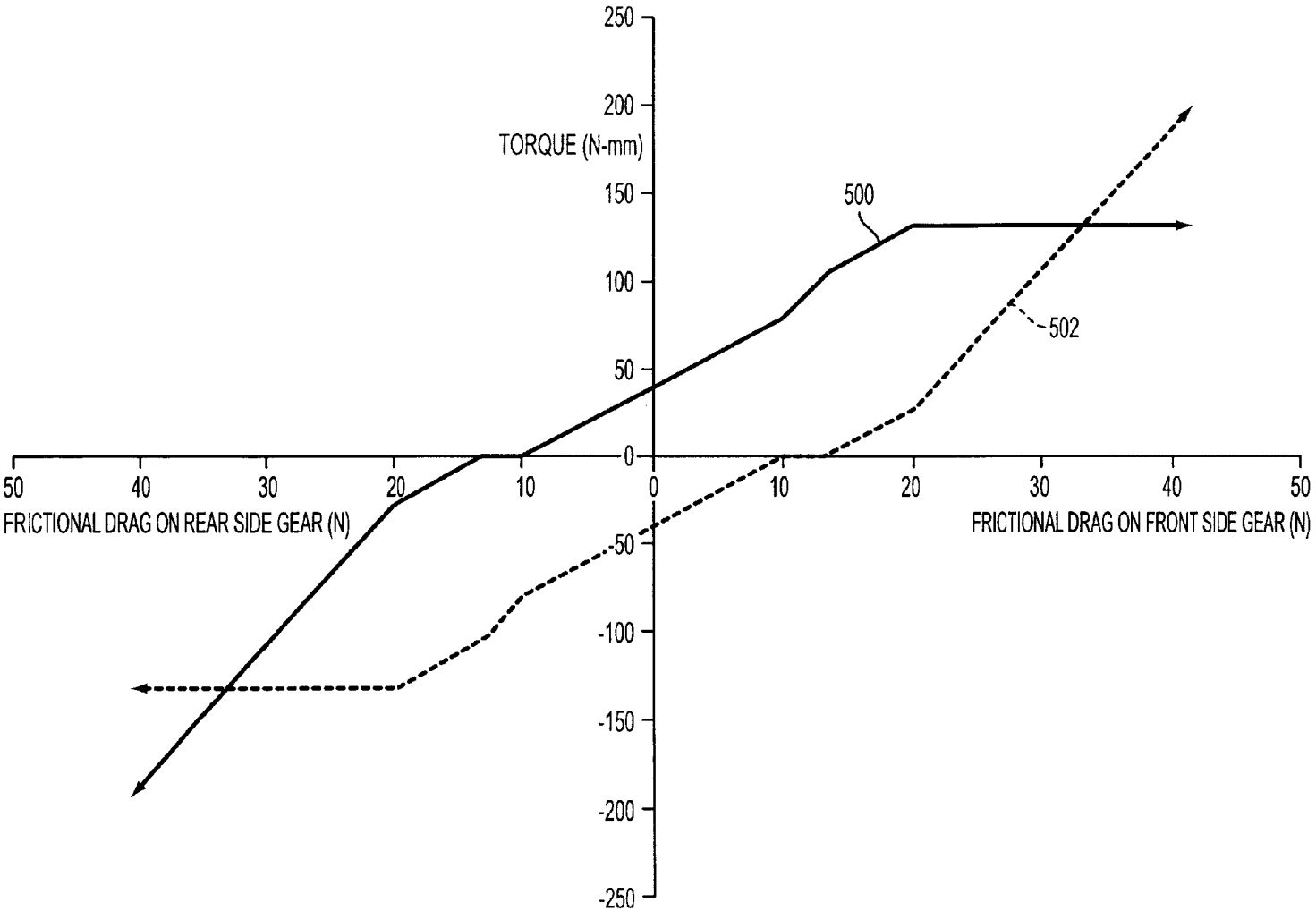
FIG. 17 is a graph illustrating the relationship between an actuating torque and torque applied to the first and second worm assemblies for a second torsional preload.

Referring now primarily to FIGS. 16-17, charts illustrating operation of a device for changing phase relationship between two rotating shafts of an internal combustion engine are shown. The charts of FIGS. 16-17 illustrate how an actuating torque provided by dragging forces applied on the front or rear side gears 116, 118 is translated into torque on the torsionally preloaded worm assemblies 102, 104 to rotate worm gear 132. The horizontal axes illustrate a representative actuating or frictional drag force applied to the side gears to advance or retard the relative rotation of the rotating shafts. The vertical axes illustrate representative values for the resulting torque on the worm assemblies 102, 104 tending to advance or retard inner camshaft 112 relative to outer camshaft 110. In the embodiment illustrated in the chart of FIG. 16, the quill assemblies are preloaded so that the torsion element, implemented in the representative embodiment by quills 230, 230', will not be subjected to a reversal of torque direction. In contrast, for the embodiment illustrated in the chart of FIG. 17, the quill assemblies have a torsion element with a lower preload that subjects the torsion element to a reversal of torque direction.

In the chart of FIG. 16, line 400 represents the relationship between torque applied to worm assembly 102, and line 402 represents the relationship between torque applied to worm assembly 104 as a function of force applied to front side gear 118 or rear side gear 116. As illustrated in the charts of FIGS. 16-17, moving toward the right hand side of the chart represents an increasing frictional drag or actuating force on the front side gear 118, while moving toward the left represents an increasing frictional drag on the rear side gear 116. Moving upward represents the resulting torque on the worm assemblies attempting to advance inner camshaft 112, and moving downward represents torque that tries to retard inner camshaft 112. When neither side gear 116, 118 has a frictional drag or actuating force, the torque applied to the two worms 260, 260' through the preloaded quills 230, 230', respectively, balance each other. Worm assembly 102 is biased toward advancing worm gear 132, while worm assembly 104 is biased toward retarding worm gear 132.

During actuation, when a frictional drag of up to 10 Newtons is applied to front side gear 118 as indicated at 408, the front side gear 118 and both worm pinion gears 120, 122 rotate. The quill 230 of worm assembly 102 sees an increasing clockwise torque, and quill 230' of worm assembly 104 sees a decreasing counterclockwise torque. However, until the counterclockwise torque applied to worm assembly 104 goes through zero between 410 and 412, and finally to a clockwise direction as indicated at 414, neither of the worms 260, 260' can turn, and no advance of worm gear 132 occurs. As the frictional drag on the front side gear increases beyond 10 Newtons, the quill clamp blade 224 at the pinion gear end of worm assembly 104 contacts the drive lugs 240, 242 on the end of the worm shaft, and the preload of quill 230 gets grounded out internally to the worm gear assembly 104. At this point, the torque applied to worm 260' can reverse to a clockwise direction. However, before front side gear 118 can apply a clockwise torque to worm assembly 104, front side gear 118 has to travel an additional amount to remove any backlash between the front side gear 118 and worm pinion 122. This additional rotation of front side gear 118 causes additional clockwise torque to the quill 230 of worm assembly 102. When front side gear 118 removes any backlash, additional rotation of front side gear 118 will impart a clockwise torque to worm assembly 104.

When both worm assemblies 102, 104 see a clockwise torque as generally indicated in area 414 of FIG. 16, an advancing torque is applied to worm gear 132. Because the dynamic torque of the camshaft associated with operation of the intake and/or exhaust valves may be much higher than the torque applied to worm gear 132 by worm assemblies 102, 104, inner camshaft 112 may be able to advance only during the portion of the dynamic torque load that is already trying to advance inner camshaft 112. At other moments, when the dynamic load of the cam action is trying to retard inner camshaft 112, worm assemblies 102, 104 may be unable to advance worm gear 132, but have enough of a mechanical advantage or friction locking to hold it from retarding.

The left hand side of the chart in FIG. 16 represents an actuating force or frictional drag on rear side gear 116 an operates in a similar fashion as described above with the function/operation of worm assemblies 102, 104 reversed to retard inner camshaft 112.

The chart of FIG. 17 illustrates operation of an embodiment having a smaller torsional preload of quills 230, 230' than the embodiment illustrated in FIG. 16. Line 500 represents worm assembly torque as a function of actuating force for worm assembly 102, while line 502 represents worm assembly torque as a function of actuating force for worm assembly 104. With a smaller torsional preload, the torsion elements implemented by quills 230, 230' are subjected to a reversal in torque direction before the corresponding quill clamp blades 224 contact the worm shaft drive lugs 240, 242 at the pinion end of the worm shafts. Depending upon the particular application and implementation, the configuration illustrated in the chart of FIG. 17 may allow the device to be more responsive and provide faster advance and retard speeds than the embodiment illustrated in the chart of FIG. 16.

Figure 18:
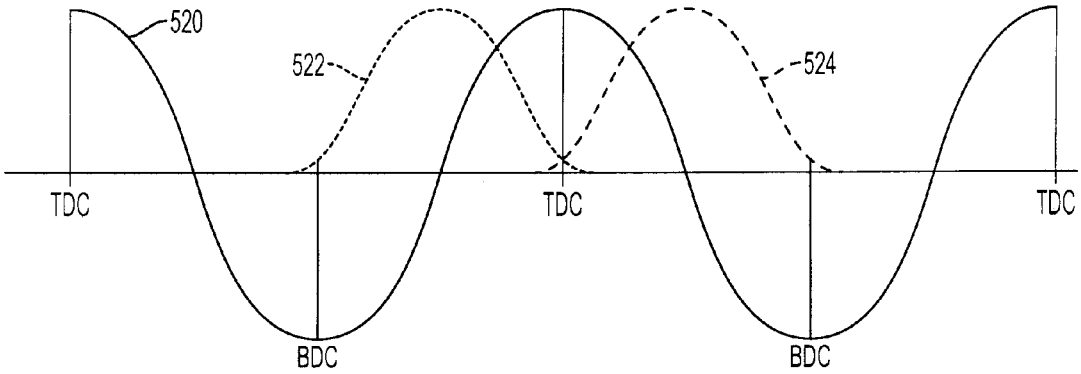
FIG. 18 is a plot illustrating operation of embodiments of a device for changing phase relationship between rotating shafts according to the present disclosure operated to provide conventional valve actuation.
Figure 19:
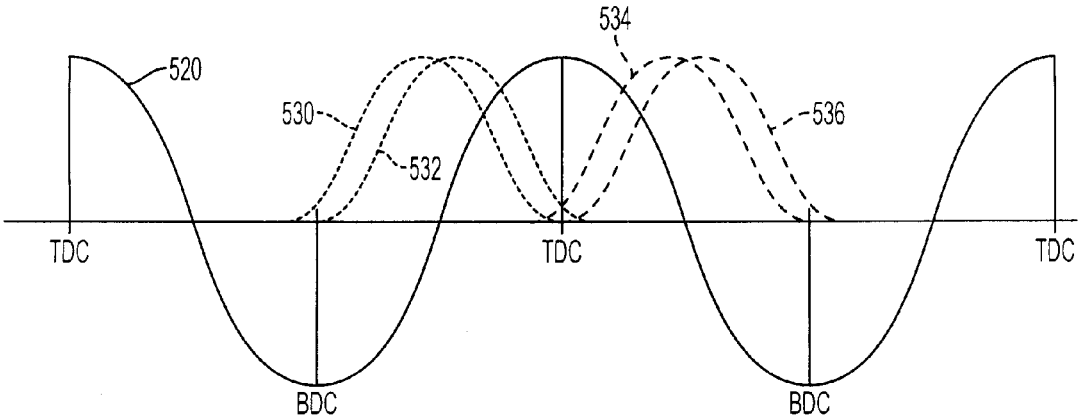
FIG. 19 is a plot illustrating offset opening and closing times of a pair of intake or exhaust valves to increase valve open duration using a device for changing phase relationship according to the present disclosure.

FIGS. 18-19 are plots illustrating gas exchange valve operation of a representative variable cam timing application using a device for selectively changing phase relationship between two or more rotating shafts according to the present disclosure. Line 520 represents piston position within a representative cylinder moving between top dead center (TDC) and bottom dead center (BDC).

The plot of FIG. 18 represents operation of a mechanical variable cam timing device according to the present disclosure with a baseline valve timing diagram similar to how a conventional camshaft operates. Line 522 represents the position or displacement of one or more exhaust valves per cylinder as they substantially simultaneously open and close relative to piston position line 520. Line 524 represents the position or displacement of one or more intake valves as they substantially simultaneously open and close relative to piston position line 520.

The plot of FIG. 19 illustrates how the duration of intake/exhaust valve opening events can be increased using a mechanical variable cam timing device in combination with a coaxial camshaft operating four valves per cylinder according to the present disclosure. Line 530 represents the position or displacement of a first exhaust valve while line 532 represents the position or displacement of a second exhaust valve on the same cylinder. Line 534 represents the position or displacement of a first intake valve and line 536 represents the position or displacement of a second intake valve on the same cylinder. As illustrated in the plot of FIG. 19, a mechanical device to selectively change phase relationship between the crankshaft (as represented by the piston position) and the camshaft according to the present disclosure may be used to increase the overall valve opening times relative to the baseline timing as represented by FIG. 18.

As illustrated in FIGS. 1-19, a method for changing relative rotational phase between first and second rotating shafts in an internal combustion engine according to the present disclosure includes biasing a first worm assembly 102 to apply a clockwise rotational bias torque between the first shaft 110 and second shaft 112, and biasing a second worm assembly 104 to apply a counterclockwise rotational bias torque between the first and second shafts 110, 112 to maintain the rotational phase between the first and second shafts during steady-state rotation, i.e. other than during phase change actuation. An actuating torque is applied through the front side gear 116 and associated worm pinions 120, 122 to the first and second worm assemblies 102, 104 during phase change actuation to selectively change the rotational phase by advancing rotation of shaft 112 relative to shaft 110 while the shafts are rotating.

As such, the systems and methods of the present disclosure provide a mechanically, non-hydraulically actuated variable camshaft timing device that can be used to adjust the phase relationship between two rotating shafts of an internal combustion engine. Various embodiments have the variable cam timing device adjusting the phase relationship between the camshaft and crankshaft and/or the phase relationship between coaxial camshafts operating intake and/or exhaust valves. Embodiments of the present disclosure provide compact packaging with desired reliability and durability such that the device can be implemented without increasing the length of camshaft bearings and with minimal or no overall increase in engine length. Opposite hand preload torque reduces or effectively eliminates backlash during operation of the device to reduce noise and wear. Friction locking within the advance/retard mechanism maintains the angular relationship between associated rotating shafts under dynamic loading during operation to reduce or eliminate need for ongoing adjustments by the actuating device.

While the best mode has been described in detail, those familiar with the art will recognize various alternative designs and embodiments within the scope of the following claims. While various embodiments may have been described as providing advantages or being preferred over other embodiments with respect to one or more desired characteristics, as one skilled in the art is aware, one or more characteristics may be compromised to achieve desired system attributes, which depend on the specific application and implementation. These attributes include, but are not limited to: cost, strength, durability, life cycle cost, marketability, appearance, packaging, size, serviceability, weight, manufacturability, ease of assembly, etc. The embodiments discussed herein that are described as less desirable than other embodiments or prior art implementations with respect to one or more characteristics are not outside the scope of the disclosure and may be desirable for particular applications.

What is claimed:

1. A device for selectively varying a relative angular position between first and second rotating shafts of an internal combustion engine, the device comprising:

a first worm assembly coupled to the first and second rotating shafts and torsionally preloaded to provide a first torque tending to increase the relative angular position between the first and second rotating shafts;

a second worm assembly coupled to the first and second rotating shafts and torsionally preloaded opposite to the first worm assembly to provide a second torque simultaneously tending to decrease the relative angular position between the first and second rotating shafts such that the relative angular position of the first and second rotating shafts remains substantially constant during rotation of the first and second rotating shafts; and at least one actuator selectively applying an actuating torque to respective gears of the first and second worm assemblies to rotate the first rotating shaft relative to the second rotating shaft and change the relative angular position between the first and second rotating shafts.

2. The device of claim 1 wherein the first worm assembly is torsionally preloaded to provide the first torque substantially equal in magnitude and opposite in hand relative to the second torque of the second worm assembly.

3. The device of claim 1 wherein the first worm assembly is torsionally preloaded to provide a first torque tending to advance rotation of the first shaft relative to the second shaft and wherein the first torque exceeds the second torque of the second worm assembly.

4. The device of claim 1 further comprising:

a worm carrier assembly secured for rotation with the first shaft;

a worm gear secured for rotation with the second shaft; and wherein the first and second worm assemblies include first and second worms, respectively, rotating within the worm carrier assembly and in meshing engagement with the worm gear.

5. The device of claim 4 wherein the at least one actuator comprises:

a first actuator for applying the actuating torque to rotate respective gears of the first and second worm assemblies in a first direction to advance rotation of the second shaft relative to the first shaft; and a second actuator for applying the actuating torque to rotate respective gears of the first and second worm assemblies in a second direction to retard rotation of the second shaft relative to the first shaft.

6. The device of claim 1 wherein the first shaft is secured for rotation with a worm carrier assembly and the second shaft is secured for rotation with a worm gear, the first and second worm assemblies being secured within the worm carrier assembly, and wherein each worm assembly comprises:

a worm secured for rotation with a worm shaft rotatable within the worm carrier assembly; and a worm pinion disposed about the worm shaft and coupled thereto through a torsion element to torsionally preload the worm assembly, each worm pinion engaging the at least one pinion actuator to provide opposite hand torsional preloads acting on the first and second rotating shafts through the worm carrier assembly and worm gear, respectively.

7. The device of claim 6 wherein the torsion element comprises:

a quill extending through the worm shaft and having a first blade secured to a first end and a second blade secured to a second end, wherein the first blade is secured for rotation with the worm pinion, the worm pinion coupled to the at least one pinion actuator such that the second blade engages at least one drive lug at the second end of the worm shaft when the actuator is not applying actuating torque, and the first blade engages at least one drive lug at a first end of the worm shaft only when the at least one actuator applies the actuating torque.

8. The device of claim 1 wherein the first rotating shaft comprises an engine crankshaft and the second rotating shaft comprises an engine camshaft.

9. The device of claim 1 wherein the first and second rotating shafts comprise camshafts.

10. The device of claim 9 wherein the camshafts comprise coaxial camshafts.

11. The device of claim 10 wherein the first shaft comprises an intake camshaft and wherein the second shaft comprises an exhaust camshaft.

12. A method comprising:

biasing a first worm assembly to apply a clockwise bias torque between first and second rotating shafts;

biasing a second worm assembly to apply a counterclockwise bias torque between the first and second rotating shafts other than during phase change actuation; and applying an actuating torque to the first and second worm assemblies during phase change actuation to selectively change the rotational phase between the first and second rotating shafts.

13. The method of claim 12 wherein the first and second worm assemblies include worm gear assemblies mounted within a common worm carrier assembly secured for rotation with one of the first and second rotating shafts.

14. The method of claim 13 wherein biasing the first worm assembly comprises biasing a worm to exert a preload torque on a worm gear secured for rotation with one of the first and second rotating shafts.

15. The method of claim 14 wherein biasing the worm comprises connecting a worm pinion to the worm through a torsion element.

16. The method of claim 13 wherein the first and second rotating shafts comprise camshafts.

17. The method of claim 13 wherein the first rotating shaft comprises a crankshaft.

18. A device for selectively changing phase relationship between first and second rotating shafts in an internal combustion engine, the first rotating shaft secured for rotation with a worm carrier assembly and the second rotating shaft secured for rotation with a worm gear, the device comprising:

first and second worms disposed for rotation within the worm carrier assembly and having torsional preloads with opposite hands of rotation, the first and second worms meshing with the worm gear; and an actuator for turning the first and second worms in a first direction to advance rotation of the second rotating shaft relative to the first rotating shaft and for turning the first and second worms in a second direction to retard rotation of the second rotating shaft relative to the first rotating shaft.

19. The device of claim 18 wherein the actuator comprises:

first and second side gears disposed on opposite sides of the worm carrier assembly and coupled to the first and second worms through corresponding first and second worm pinions in meshing engagement with the first and second side gears.

20. The device of claim 18 wherein the first shaft comprises a crankshaft.

* * * * *